US009447798B1

(12) United States Patent
Raymond

(10) Patent No.: US 9,447,798 B1
(45) Date of Patent: Sep. 20, 2016

(54) FLUID POWERED LINEAR PISTON MOTOR WITH HARMONIC COUPLING

(71) Applicant: Sandia Corporation, Albuquerque, NM (US)

(72) Inventor: David W. Raymond, Edgewood, NM (US)

(73) Assignee: Sandia Corporation, Albuquerque, NM (US)

( * ) Notice: Subject to any disclaimer, the term of this patent is extended or adjusted under 35 U.S.C. 154(b) by 344 days.

(21) Appl. No.: 14/209,840

(22) Filed: Mar. 13, 2014

Related U.S. Application Data

(63) Continuation-in-part of application No. 14/198,377, filed on Mar. 5, 2014, now abandoned.

(60) Provisional application No. 61/785,539, filed on Mar. 14, 2013.

(51) Int. Cl.
*F15B 15/02* (2006.01)
*F15B 15/06* (2006.01)

(52) U.S. Cl.
CPC ..... *F15B 15/02* (2013.01); *F15B 15/063* (2013.01)

(58) Field of Classification Search
CPC .... F15B 15/02; F15B 15/068; F15B 15/063; F01L 21/04
USPC ..... 91/61, 281; 175/106, 107
See application file for complete search history.

(56) References Cited

U.S. PATENT DOCUMENTS 1,413,499 A * 4/1922 Smith ..... E21B 19/086 173/105
2,051,839 A * 8/1936 Gartin ..... F01B 17/00 91/239
2,081,919 A * 6/1937 Gartin ..... E21B 21/01 173/78
3,059,619 A * 10/1962 Beaumont ..... E21B 4/14 173/138
3,612,191 A * 10/1971 Martini ..... E21B 4/14 173/136
3,766,831 A * 10/1973 Yeakley ..... F15B 15/063 91/61
6,609,577 B2 * 8/2003 Beccu ..... B25B 19/00 173/104
6,742,605 B2 * 6/2004 Martini ..... E21B 4/14 175/107
7,416,034 B2 * 8/2008 Downie ..... E21B 4/006 175/106

* cited by examiner

*Primary Examiner* — Thomas E Lazo
(74) *Attorney, Agent, or Firm* — Daniel J. Jenkins

(57) ABSTRACT

A motor is disclosed that includes a module assembly including a piston that is axially cycled. The piston axial motion is coupled to torque couplers that convert the axial motion into rotary motion. The torque couplers are coupled to a rotor to rotate the rotor.

19 Claims, 17 Drawing Sheets

FLUID POWERED LINEAR PISTON MOTOR WITH HARMONIC COUPLING

CROSS-REFERENCE TO RELATED APPLICATIONS

This application is a Continuation-in-Part of U.S. patent application Ser. No. 14/198,377, "FLUID POWERED LINEAR PISTON MOTOR WITH HARMONIC COUPLING", filed on Mar. 5, 2014, which claims benefit of U.S. Provisional Patent Application No. 61/785,539, "AIR/HYDRAULIC MOTOR WITH PISTON/RECIRCULATING BALL TRANSFER MECHANISM", filed Mar. 14, 2013, and both are incorporated by reference herein in their entirety.

STATEMENT OF GOVERNMENT INTEREST

The United States Government has rights in this invention pursuant to Contract No. DE-AC04-94AL85000 between the United States Department of Energy and Sandia Corporation, for the operation of the Sandia National Laboratories.

FIELD

The present invention relates to the field of drilling, and specifically to using a pressurized fluid to drive a rotational drill assembly.

BACKGROUND

Downhole drills are used for oil drilling, geothermal drilling, and other deep earth penetration applications. Downhole drills include rotary and percussive drills. For nearly any drilling method, rotational energy must be transferred downhole in order to promote rock reduction. The drill bit may be rotated by an electric motor or fluid/hydraulic system. The rotating action can be produced either at the surface or near the drill bit. In addition to rotational cutting, drills may also be pressurized or mechanically actuated to force the drill bit to hammer against the rock/earth. Prior art rotation systems and methods are complex, require large form factors to create sufficient torque, and require a high degree of maintenance.

The most common method of downhole energy transfer is rigid drill pipe. The drill pipe is rotated from the surface, with drilling joints added for tripping (moving in and out of the hole). For this type of system, the entire drill string rotates. Typically a rotary table system or a top drive is used to drive the drill string. Although it is well suited for vertical drilling, it has limited applications in directional drilling because the drill string curvature and thrust loads generate additional torque that the surface based motor must overcome and drill pipe survive.

Downhole techniques used to generate rotation such as positive displacement motors (PDMs) are limited in their temperature range due to the use of elastomers. Energy resources like geothermal and deep oil and gas wells lie in hot (160° C.-300° C.), and often hard rock. The high-temperatures limit the use of PDM's in those environments.

What is needed is a drill rotation system and method that overcomes the limitations of the prior art.

SUMMARY

According to an embodiment of the invention, a motor is disclosed that includes a housing and a piston drive section disposed within the housing. The piston drive section includes a rotor and a module assembly disposed around the rotor. The module assembly includes a piston assembly having a first end and a second end, a first and second torque couplers coupled to the first and second ends of the piston assembly, respectively, and further coupled to the rotor. Axial motion of the piston assembly within the housing causes the first and second torque couplers to rotate the rotor According to another embodiment of the invention, a drill assembly is disclosed that includes a housing, a piston drive section disposed within the housing, an output section coupled to the piston drive section, and a drill bit coupled to the output section. The piston drive section includes a rotor and a module assembly disposed around the rotor. The module assembly includes a piston assembly having a first end and a second end, and first and second torque couplers coupled to the first and second ends of the piston assembly, respectively, and further coupled to the rotor. Axial motion of the piston assembly within the housing causes the first and second torque couplers to rotate the rotor.

According to another embodiment of the invention, a method of powering a motor is disclosed that includes providing a pressured fluid to an inlet of a rotor housing of a rotor of the motor, porting the pressured fluid to a first chamber of a piston assembly disposed around the rotor at an initial position to drive a piston of the piston assembly in a first axial direction in the housing by the pressurized fluid, porting the pressurized fluid from the first chamber to an exhaust manifold disposed within the rotor housing, and porting additional pressurized fluid to a second chamber of the piston assembly disposed around the rotor to drive the piston in a second axial direction opposite the first axial direction to return the piston to the initial position.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
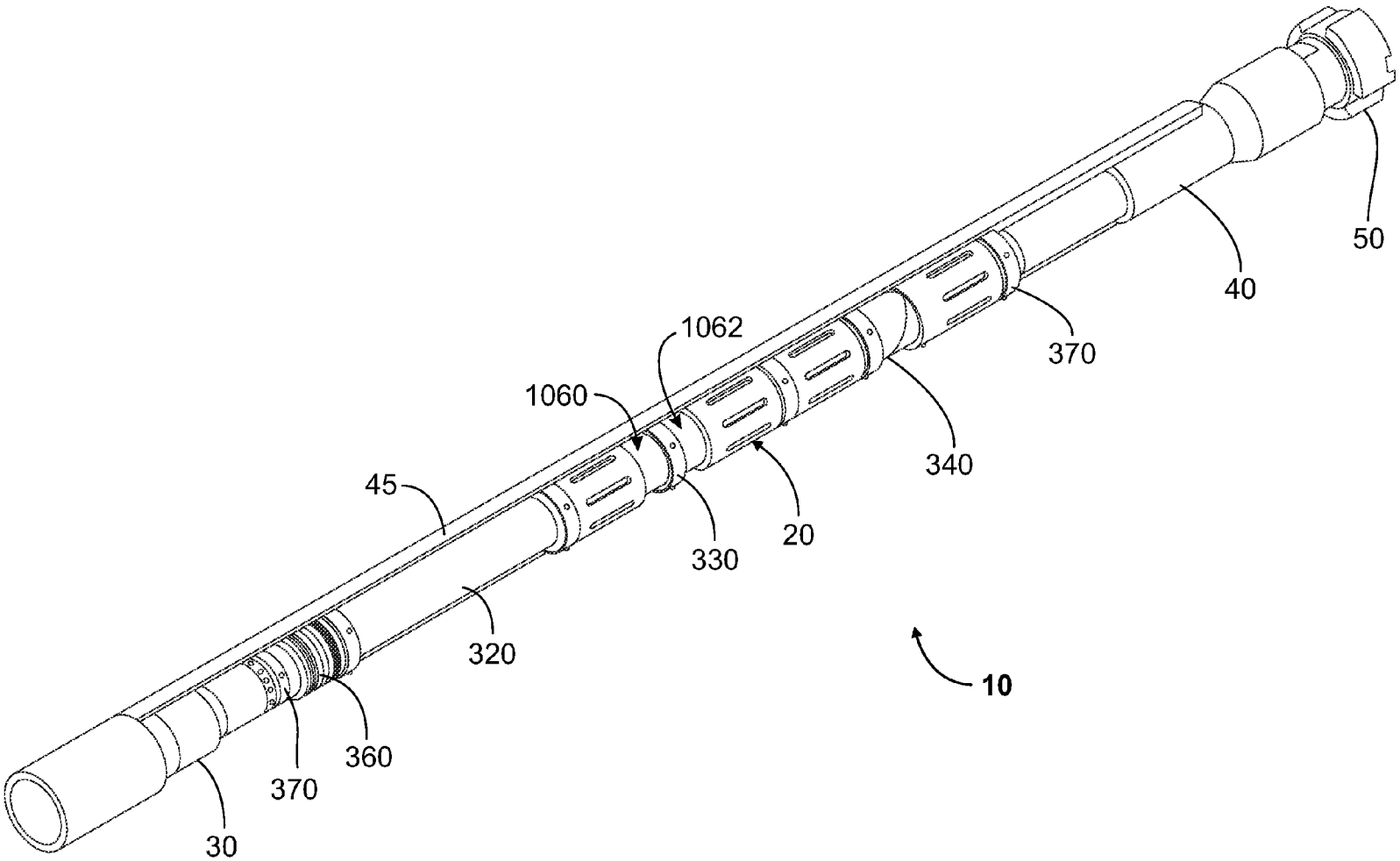
FIG. 1 illustrates a partial see-through, perspective view of an embodiment of a fluid motor according to the disclosure.
Figure 2:
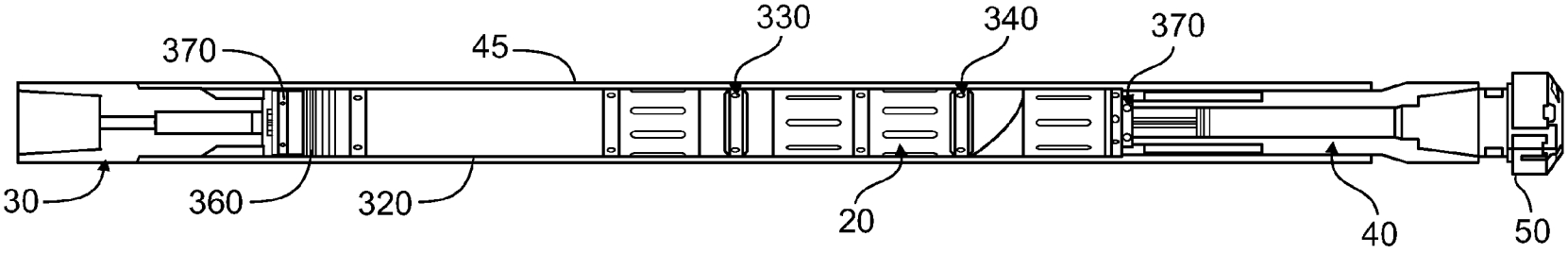
FIG. 2 shows a side cut away view of the fluid motor of FIG. 1.

FIGS. 1 and 2 illustrate an embodiment of a fluid motor 10 according to the disclosure. As can be seen in FIG. 1, the fluid motor includes a power or piston drive section, an inlet section 30 and outlet section 40 disposed within a housing 45. In this exemplary embodiment, the outlet section 40 is coupled to a rotary bit assembly 50.

Figure 3:
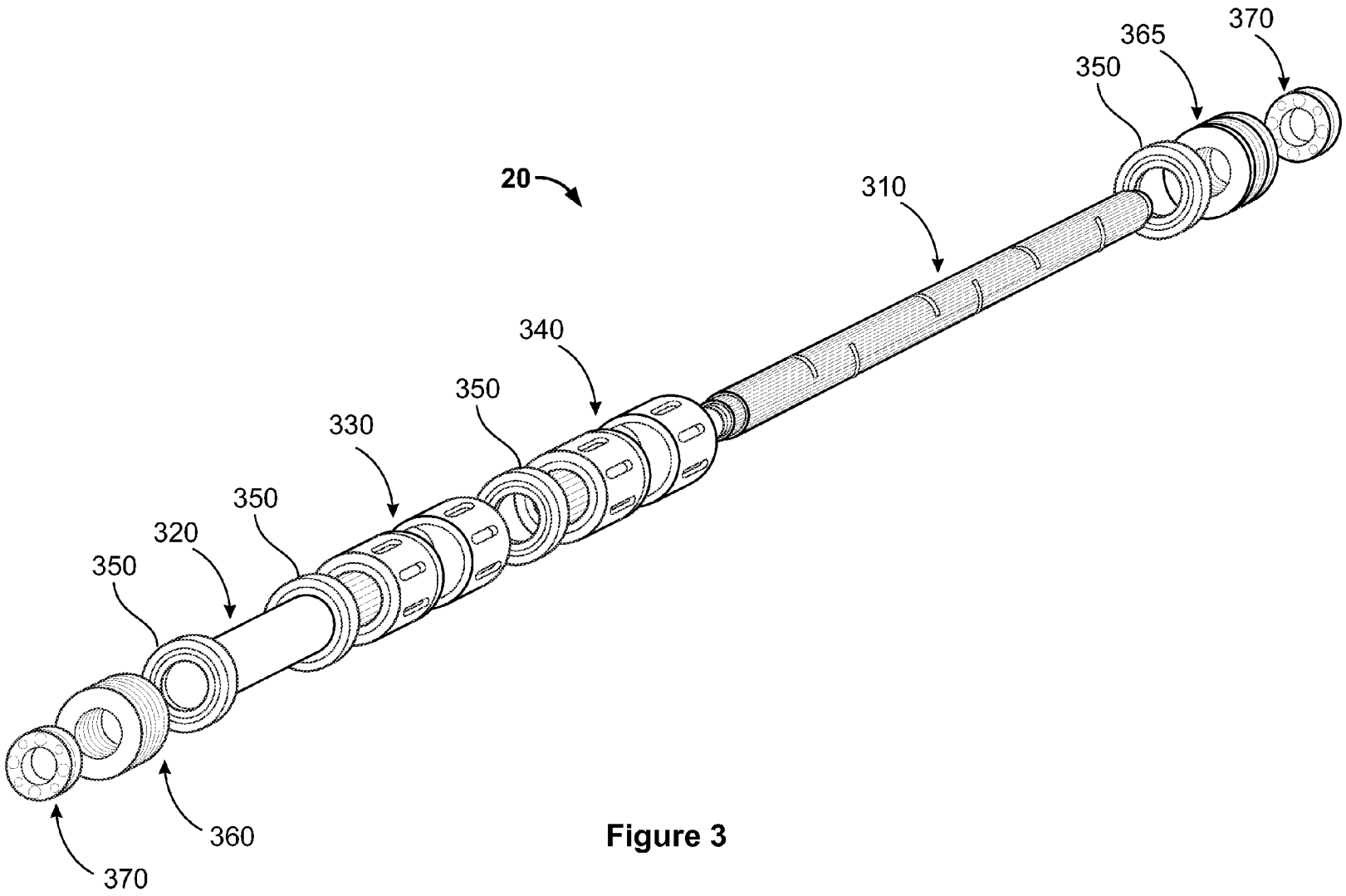
FIG. 3 shows an exploded view of a piston drive assembly according to an embodiment of the disclosure.

FIG. 3 is a partially exploded view of the piston drive section 20 according to an embodiment of the disclosure. As can be seen in FIG. 3, the piston drive section 20 includes a rotor assembly 310, a spacer 320, a first module assembly 330, a second module assembly 340, bearings 350, spring 360, washers 365 and retainers 370. The bearings 350, spring 360, washers 365 and retainers 370 are assembled as shown to assemble the first and second module assemblies 330, 340 upon the spline assembly 310 under a preload. In this exemplary embodiment, the piston drive section 20 includes two module assemblies 330, 340, however, in another embodiment, the piston drive section 20 may include one or more module assemblies. Also in this exemplary embodiment, two bearings 350 are shown pre-attached to the spacer 320. In another embodiment, washers 365 may be positioned at other locations axially along the rotor assembly 310, or may be deleted. In another embodiment, one or more springs 360 may be positioned axially along the rotor assembly 310.

In this exemplary embodiment, the piston drive section 20 includes one spacer 320. In another embodiment, the piston drive section may include one or more spacers 320 located at one or more positions axially along the rotor assembly 310. In another embodiment, spacers 320 may be replaced with another module to increase the output power of the fluid motor 10.

Figure 4:
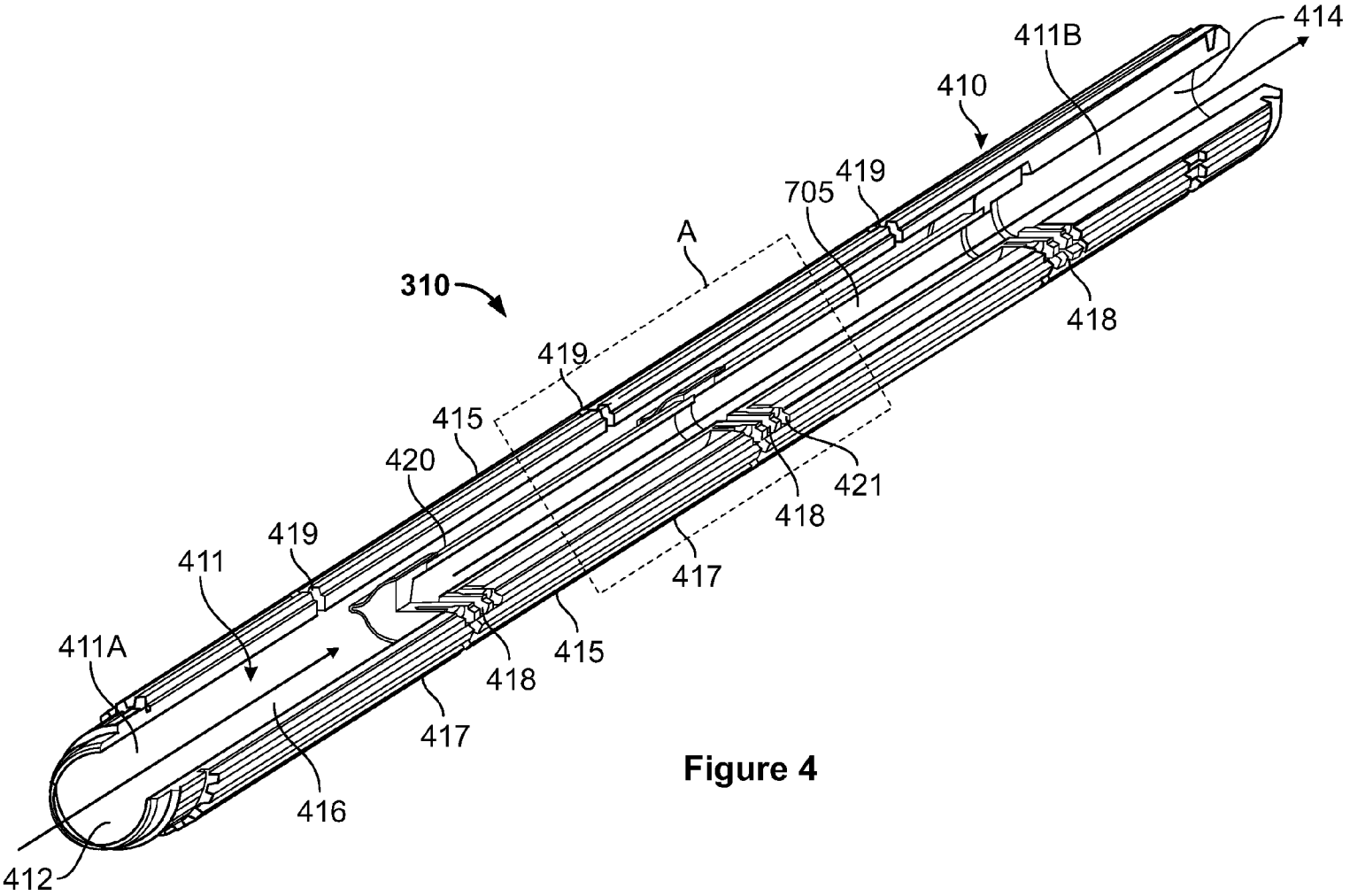
FIG. 4 shows a cut away view of a rotor assembly according to an embodiment of the invention.
Figure 5:
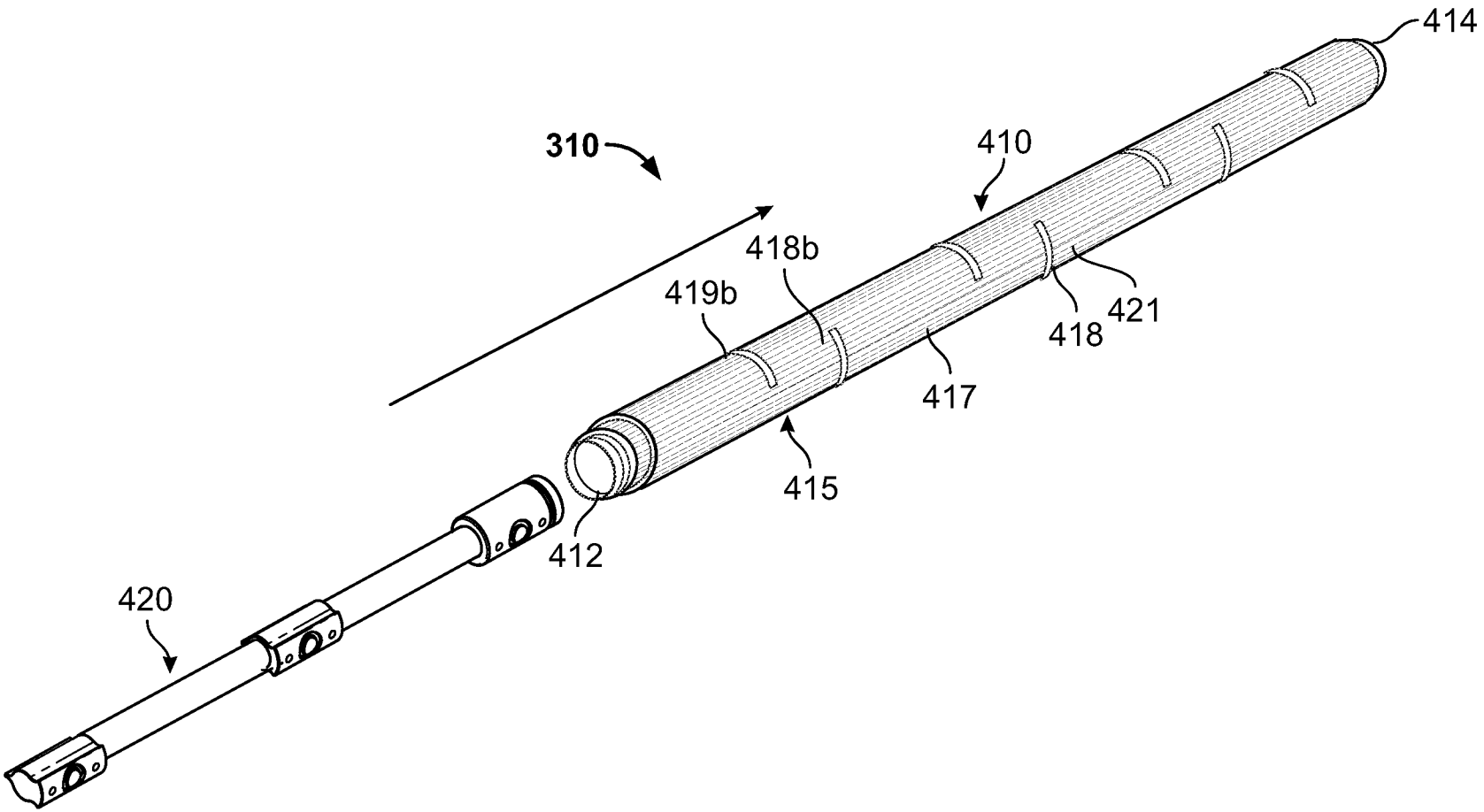
FIG. 5 shows an exploded view of the rotor assembly of FIG. 4.
Figure 6:
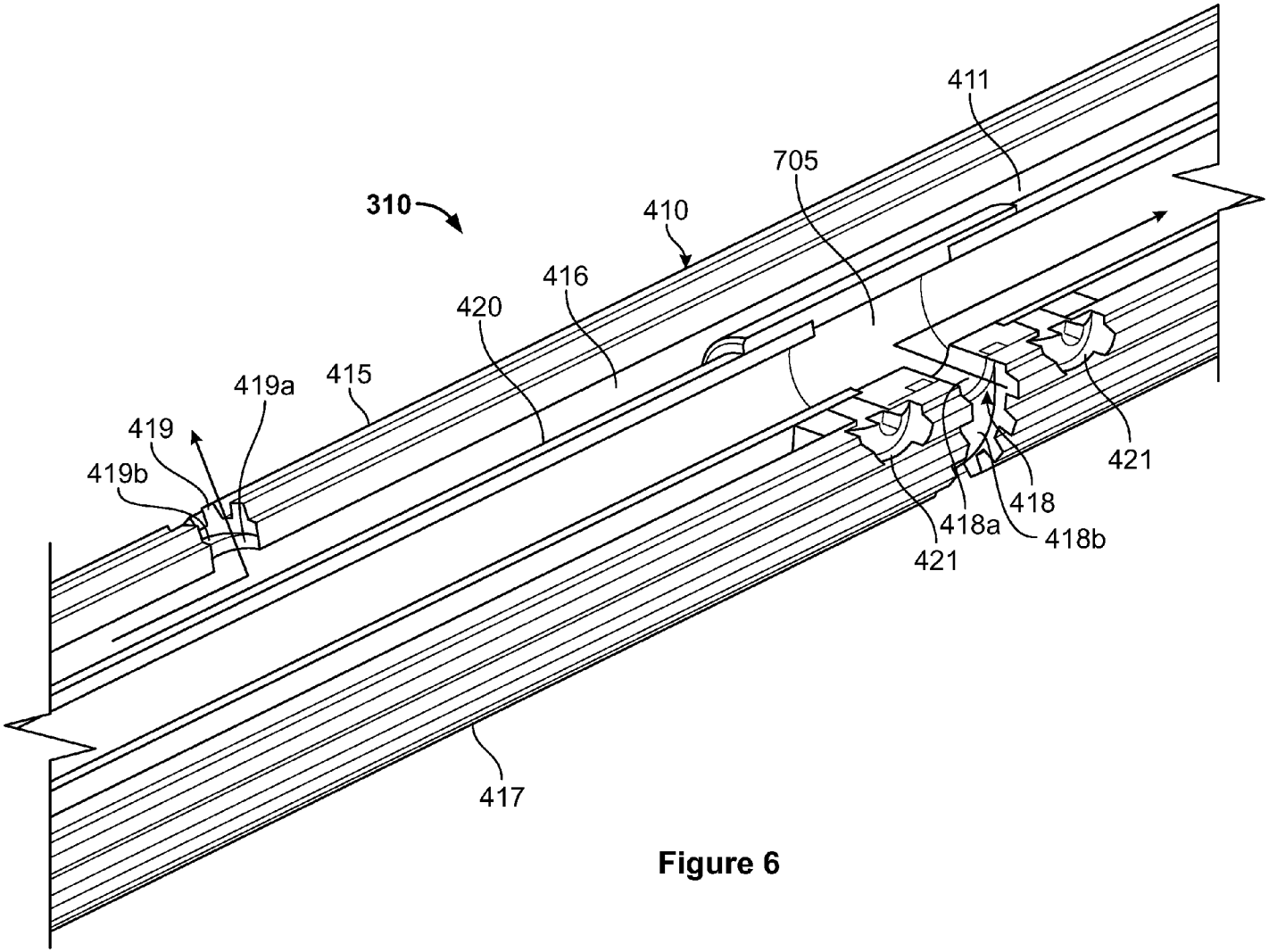
FIG. 6 shows a cut away view of a portion A of the rotor assembly of FIG. 4.

FIGS. 4, 5 and 6 show different views of a rotor assembly 310 according to an embodiment of the disclosure. As can be seen in FIGS. 4-6, the rotor assembly 310 includes a rotor housing 410 and an exhaust manifold 420. The rotor housing 410 has a through passage 411 having a pressure inlet 412 and an exhaust outlet 414.

The rotor housing 410 also has an outer surface 415 and an inner surface 416. The outer surface 415 includes splines 417 disposed on the surface thereof. In this exemplary embodiment, the outer surface 415 has splines 417 substantially covering the entire outer surface 415. In another embodiment, the outer surface 415 may have splines 417 covering only a portion of the outer surface 415.

The rotor housing 410 also includes pressure ports 419 that allow a fluid to pass from the inner surface 416 to the outer surface 415. In this exemplary embodiment, the rotor housing 410 includes three pressure ports 419. As can be seen in FIG. 6, the pressure ports 419 include an opening 419*a* into the inner surface 416 and a radial slot 419*b* in the outer surface 415 of the rotor housing 410. The radial slot 419*b* provides for increased fluid collection over the surface of the rotor housing 410. In another embodiment, the rotor housing 410 may include one or more pressure ports 419.

The rotor housing 410 also includes exhaust ports 418 that allow a fluid to pass from the outer surface 415 to the inner surface 416. In this exemplary embodiment, the rotor housing 410 includes three exhaust ports 418. As can be seen in FIG. 6, the exhaust ports 418 include an opening 418*a* into the inner surface 418 and a radial slot 418*b* in the outer surface 415 of the rotor housing 410. The radial slot 418*b* provides for increased fluid collection over the surface of the rotor housing 410. In another embodiment, the rotor housing 410 may include one or more exhaust ports 418.

The rotor housing 410 also includes fastener openings 421 between the outer surface 415 and the inner surface 416 that allow a fastener to attach the exhaust manifold 420 to the rotor housing 410.

Figure 7:
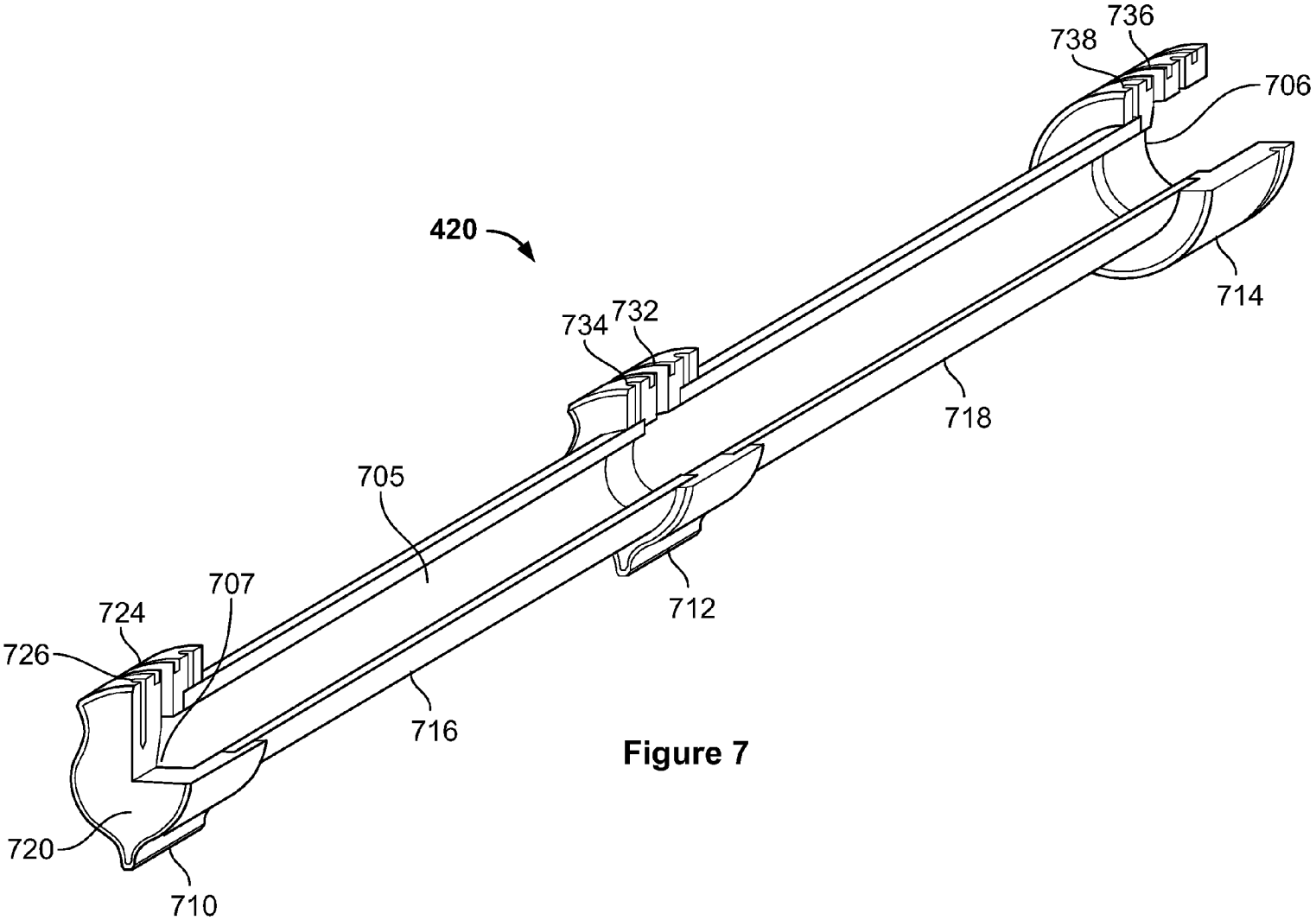
FIG. 7 shows a cross sectional view of an exhaust manifold 420 according to an embodiment of the disclosure.

FIG. 7 shows a cross sectional view of an exhaust manifold 420 according to an embodiment of the disclosure. As can be seen in FIG. 7, the exhaust manifold 420 includes a fluid passageway 705, a first port junction 710, a second port junction 712 and a port collar 714. The fluid passage 705 has a first end 706 that is open and a second end 707 that is closed.

The first port junction 710 is fluidly connected the second port junction 712 by a first exhaust pipe 716. The second port junction 712 is fluidly connected to the port collar 714 by a second exhaust pipe 718. In another embodiment the first and second exhaust pipes 716, 718 may be replaced with a single exhaust tube that has corresponding ports.

The first port junction 710 includes an end cap 720 for sealing a first end 722 of fluid passage 705. The first port junction 710 also includes a first exhaust port 724 for allowing a fluid to enter the fluid passageway 705, and a first fastener attachment point 726 for allowing the first port junction 710 to be attached to the rotor housing 410 (see FIGS. 4 and 6).

The second port junction 712 includes a second exhaust port 732 for allowing a fluid to enter the fluid passageway 705, and a second fastener attachment point 734 for allowing the second port junction 712 to be attached to the rotor housing 410 (see FIGS. 4 and 6).

The port collar 714 includes a third exhaust port 736 for allowing a fluid to enter the fluid passageway 705, and a collar attachment point 738 for allowing the port collar 714 to be attached to the rotor housing 410 (see FIGS. 4 and 6).

As can be seen in FIG. 7, the exhaust manifold 420 is configured so that the port collar 714 creates a seal between the exhaust manifold 420 and the rotor 410. Referencing FIGS. 4 and 7, it can be seen that in such a manner, the through passage 411 is divided into a pressure chamber 411A and an exhaust chamber 411B. As the exhaust manifold 420 is open to the through passage 411 at open end 706 and closed at closed end 707, the through passage 411 is part of the exhaust chamber 411B.

In this exemplary embodiment, the rotor assembly 310 has three pressure and exhaust ports, with the first pressure and exhaust ports being covered or sealed by the sleeve 320. In another embodiment, the rotor assembly 310 may be configured with one or more pressure and exhaust ports, corresponding to the number of module assemblies.

As can be seen in FIGS. 4 and 6, a pressurized fluid may enter the pressure chamber 411A and be available to be discharged outside of the rotor housing 410 through pressure ports 419, and a pressurized fluid may be collected through exhaust ports 418 into exhaust chamber 411B to be exhausted from the rotor housing 410.

Figure 8:
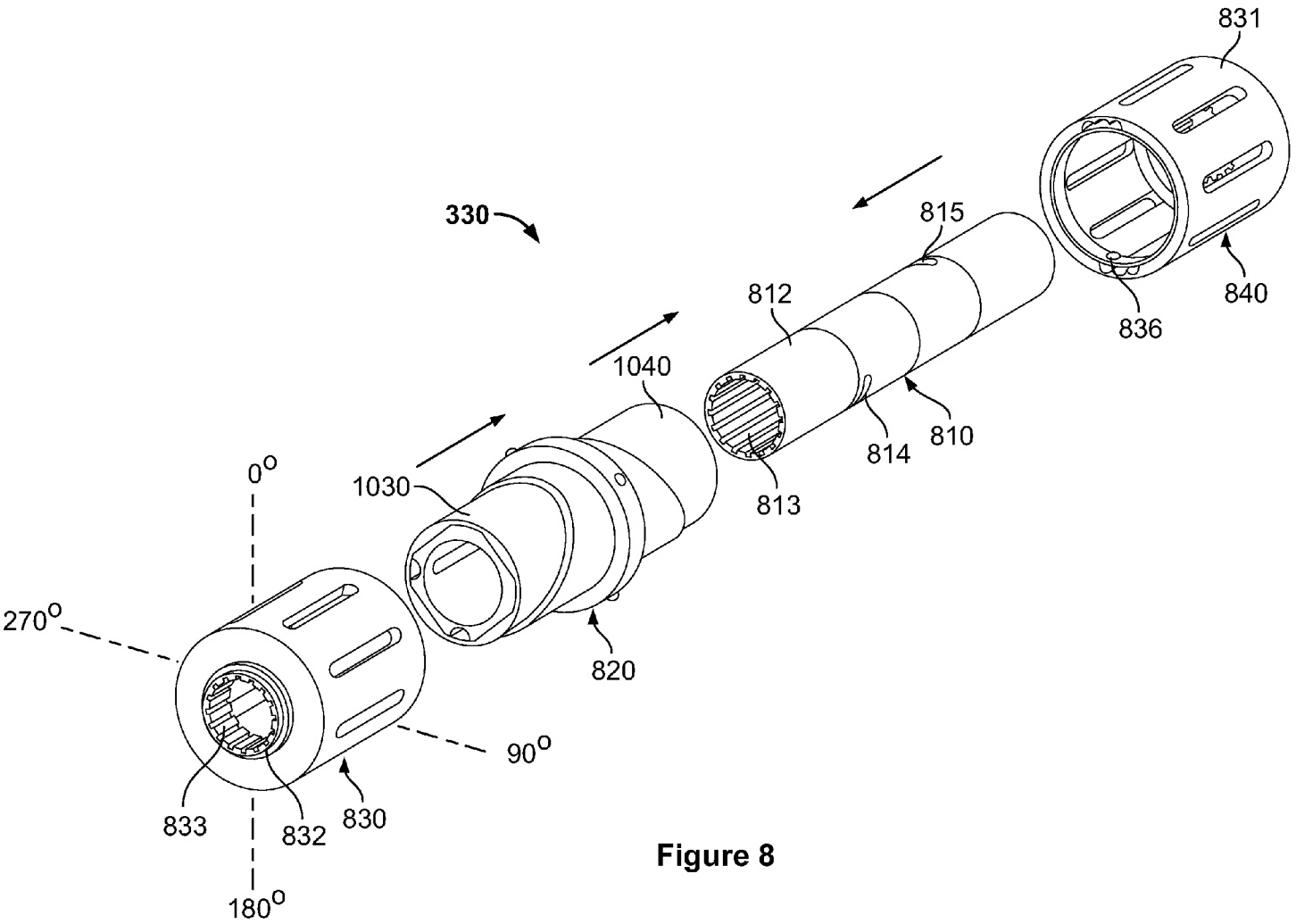
FIG. 8 shows an exploded view of a module assembly according to an embodiment of the invention.

FIG. 8 shows an expanded view of a module assembly 330 according to an embodiment of the disclosure. The module assemblies may be referred to as a piston/rotary transfer mechanism, since the module assemblies convert a piston action into a rotary motion. As can be seen in FIG. 8, the module assembly 330 includes a valve sleeve 810, a piston assembly, 820, a first torque coupler 830 and a second torque coupler 840. The valve sleeve 810 includes a valve sleeve body 811 having an outer surface 812, a splined inner surface 813, a pressure inlet slot 814 and an exhaust outlet slot 815. The splined inner surface 813 is configured to surround and engage with the outer splined surface 415 of rotor housing 410. In such a manner, rotation of the rotor housing 410 directly rotates the valve sleeve 810. The piston assembly 820 is disposed upon the valve sleeve 810 such that the valve sleeve 810 may freely rotate within the piston assembly 820.

Figure 9:
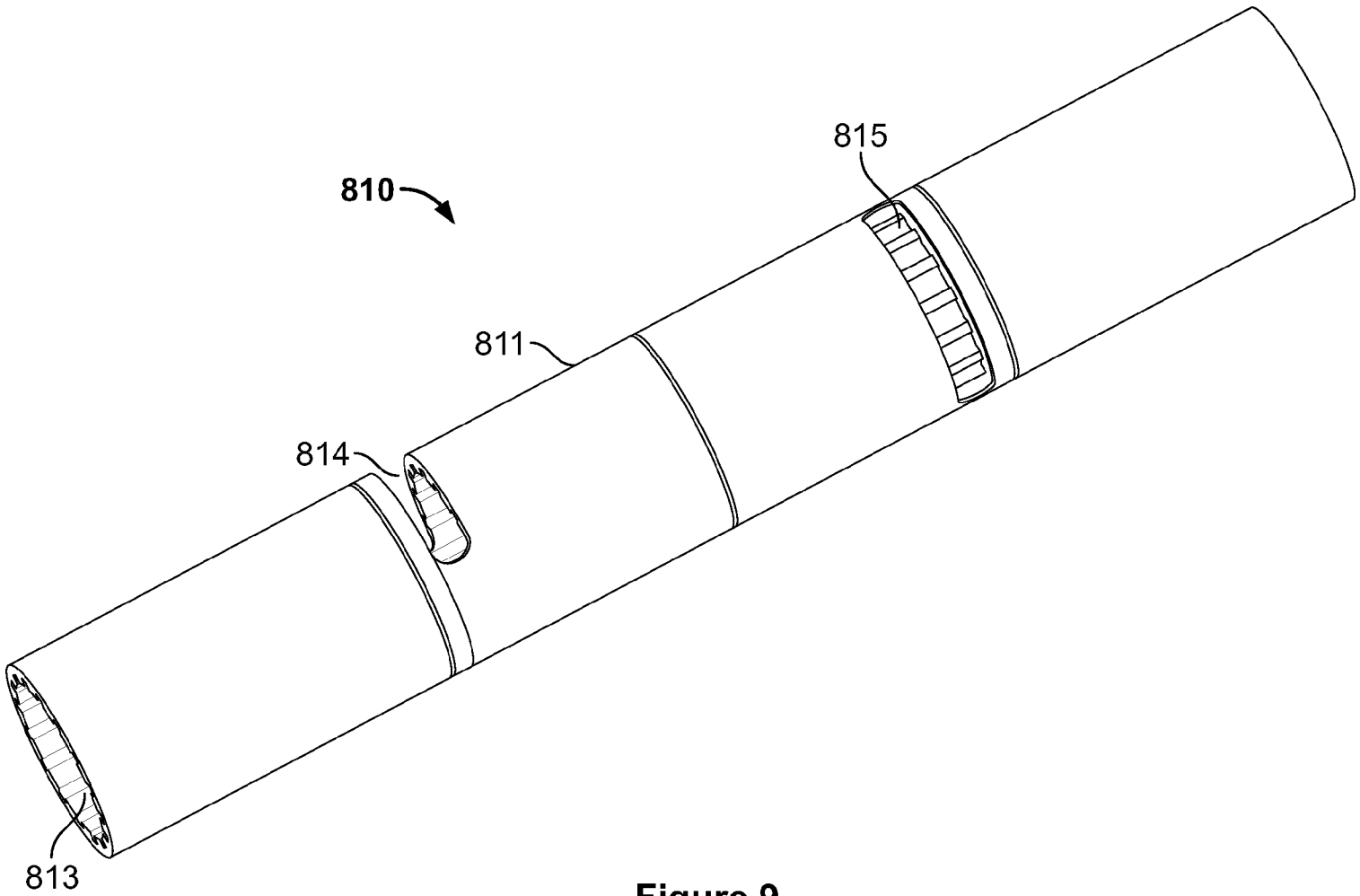
FIG. 9 shows a perspective view of a valve sleeve according to an embodiment of the disclosure.

FIG. 9 shows a more detailed view of the valve sleeve 810 according to an embodiment of the disclosure. As can be seen in FIG. 9, the pressure inlet slot 814 and exhaust outlet slot 815 are offset 90 degrees, circumferentially. The pressure inlet slot 814 and exhaust outlet slot 815 are slotted through the valve sleeve body 811 for about 180 degrees of circumference of the valve sleeve body 811, however, the amount of degree of the slot may be varied slightly to adjust the cycle timing of the piston assembly 820 upon the valve sleeve 810 to provide preferred differential pressures across the piston to drive the motor.

Referring again to FIG. 8, the first and second torque couplers 830, 840 are disposed over the first and second harmonic cams 1030, 1040 of the piston assembly 820. The first and second torque couplers 830, 840, which have the same size and shape, include an outside surface 831 and an inside surface 832. The inside surface 832 includes a splined surface 833 for engaging the splines 417 of the rotor 410 (see FIG. 5). In such a manner, rotation of the first and second torque couplers 830, 840 rotates the rotor 410. The inside surface 832 also includes a guide ball 836. The inside surface 832 is in contact with bearings (not shown in FIG. 8) for reducing friction between the first and second torque couplers 830 and the piston assembly 820.

Figure 10:
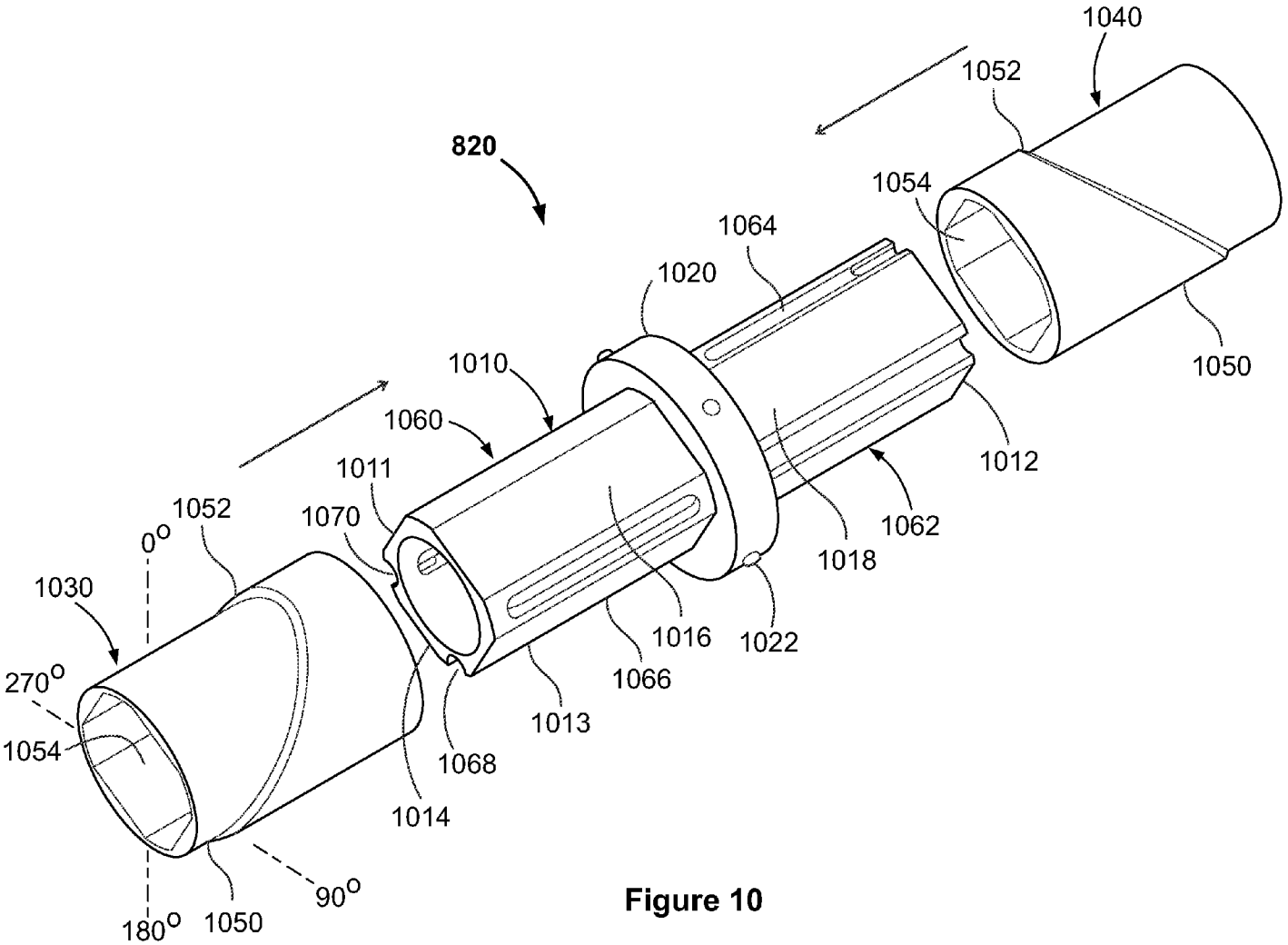
FIG. 10 shows an exploded view of a piston assembly according to an embodiment of the disclosure.
Figure 11:
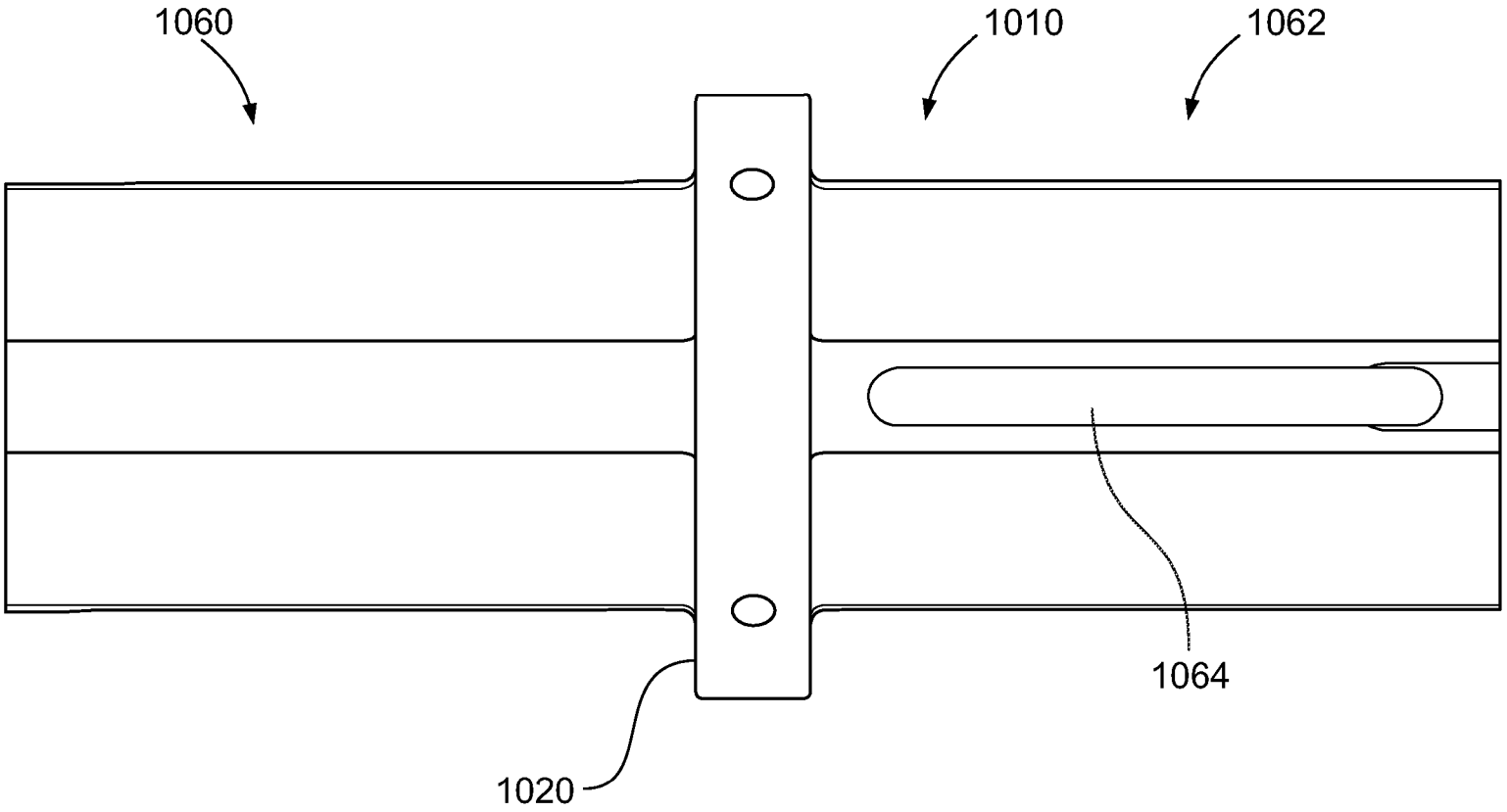
FIG. 11 shows a top view of a piston assembly body according to an embodiment of the disclosure.
Figure 12:
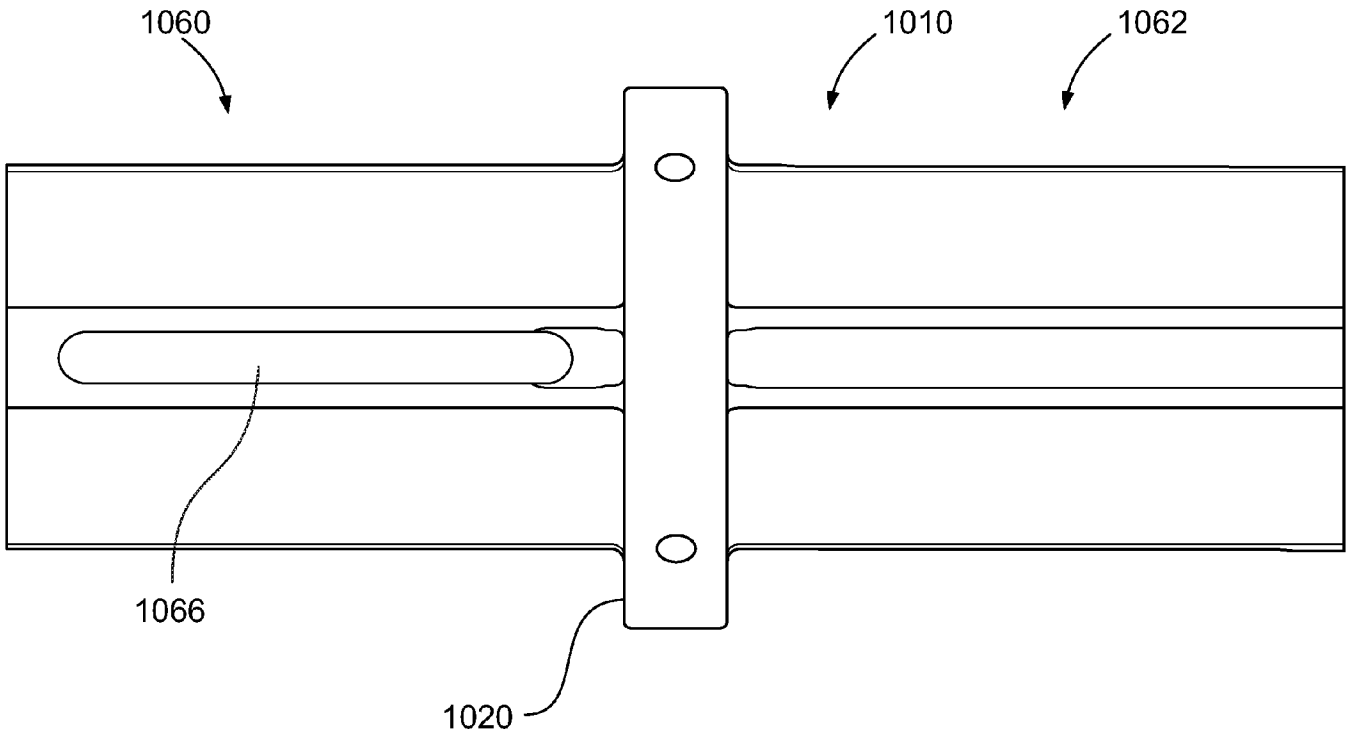
FIG. 12 shows a first side view of a piston assembly body according to an embodiment of the disclosure.
Figure 13:
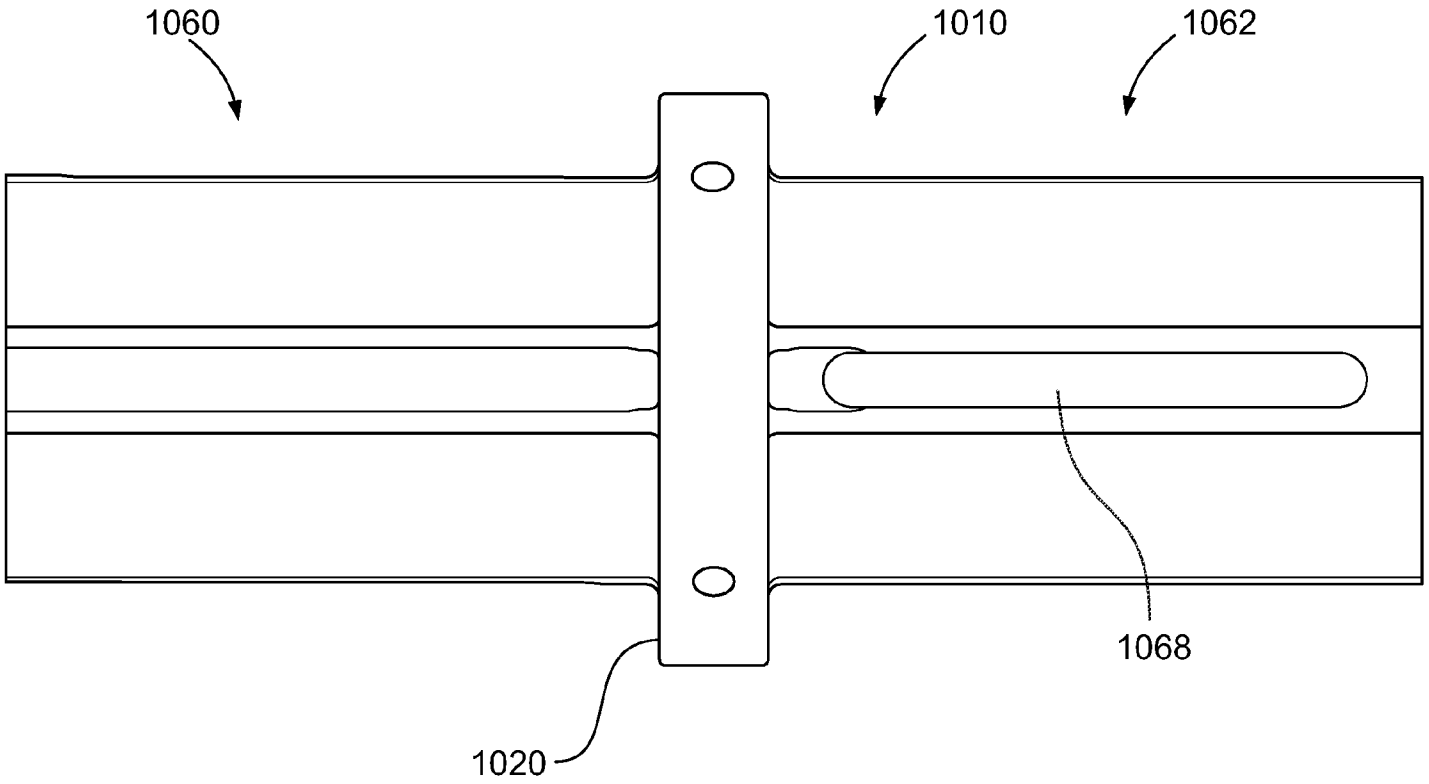
FIG. 13 shows a bottom view of a piston assembly body according to an embodiment of the disclosure.
Figure 14:
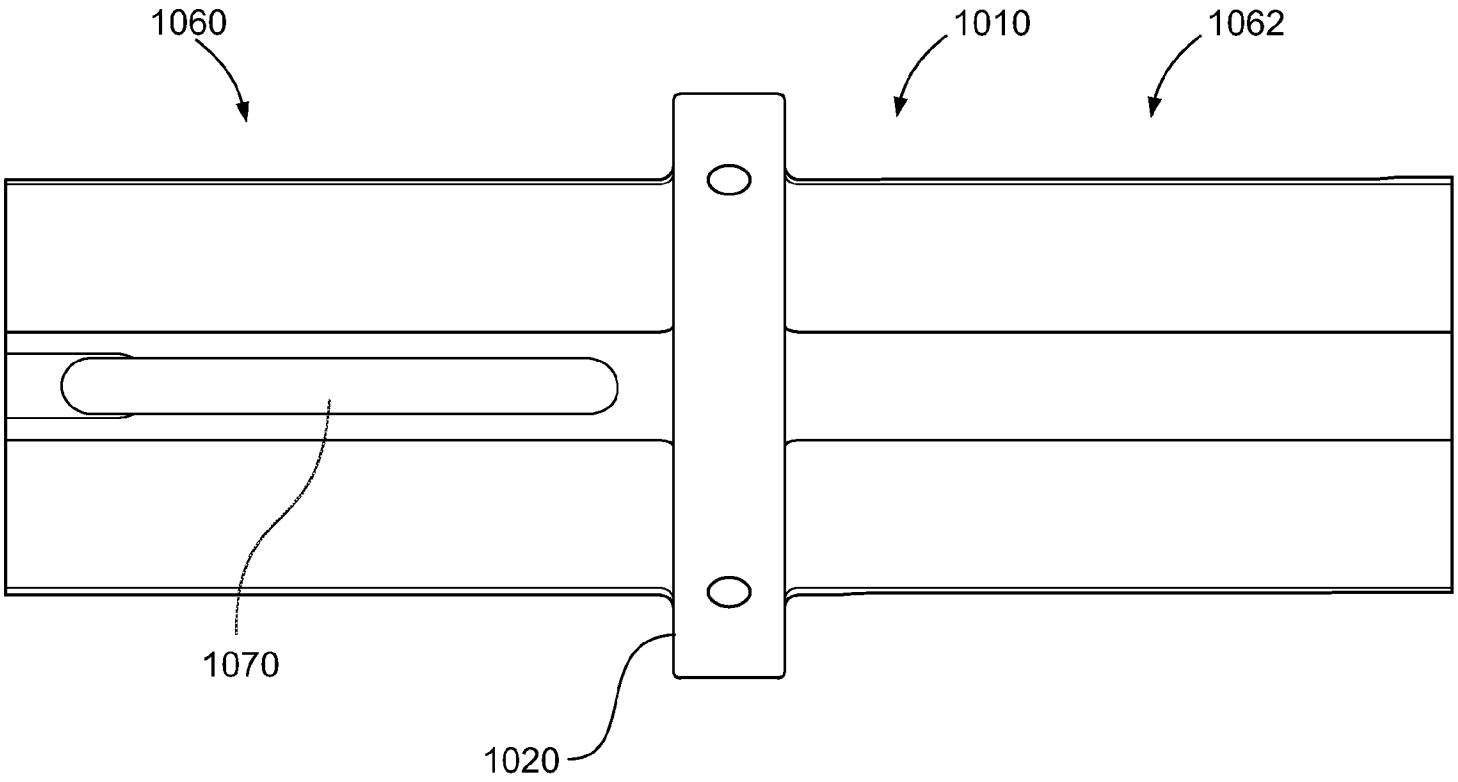
FIG. 14 shows a second side view of a piston assembly body according to an embodiment of the disclosure.

FIG. 10 shows a more detailed view of the piston assembly 820 according to an embodiment of the disclosure. As can be seen in FIG. 10, the piston assembly 820 includes a piston assembly body 1010 having a first end 1011, a second end 1012, an outside surface 1013, and inside surface 1014, a piston assembly collar 1020 disposed around the axial midpoint of the piston assembly body 1010, a first harmonic cam 1030 disposed around the first end 1011, and a second harmonic cam 1040 disposed around the second end 1012. The piston assembly collar 1020 includes protrusions 1022 that lock in corresponding slots or grooves (not shown) in the fluid motor housing 45 (see FIGS. 1 and 2) that allow the piston assembly 820 to axially or linearly move within the piston assembly housing 45 but prevent the piston assembly 820 to radially move or rotate within the piston assembly housing 45. In this exemplary embodiment, the protrusions 1022 are balls, but in another embodiment, the protrusions 1022 may be ribs, nubs, a spline, or other low friction protrusions.

The first and second harmonic cams 1030, 1040 have the same geometry and shape. The first and second harmonic cams 1030, 1040 have an outside surface 1050 that includes a curved ridge 1052. The curved ridge 1052 circumferentially surrounds the outer surface 1050 to produce a "cam" surface. The cam surface uses a surface of revolution that follows a sine wave. The cam surface can be prescribed using harmonic motion, cycloidal, or other methods commonly used in cam design. The first and second harmonic cams 1030, 1040 also have an inside surface 1054 that mates to the outside surface 1013 of the piston assembly body 1010 thereby preventing any rotational movement between first and second harmonic cams 1030, 1040 and the piston assembly body 1010.

The piston assembly body 1010 will be discussed using an end view reference grid as shown on FIGS. 8 and 10. In this reference grid, top dead center (TDC) is 0 degrees (0°). As can be seem in FIGS. 1, 10-14, 15 and 17, the piston assembly body 1010 includes a first side surface 1016 and a second side surface 1018 separated by collar 1020 and at least partially defining a first chamber 1060 and a second chamber 1062, respectively. The first and second chambers 1060, 1062 are defined between face of the piston assembly collar 1020 and a corresponding bearing 350 (FIG. 3). The bearing 350 includes a baffle plate (not shown) to provide a pressure seal. The piston body 1010 includes a first chamber pressure inlet 1070 located at 270°, a first chamber pressure outlet 1068 located at 180°, a second chamber pressure outlet 1064 located at 0°, and a second chamber pressure inlet 1066 located at 90°. The first and second chamber pressure inlets and outlets 1070, 1068, 1066, 1064 are slots in the piston assembly body that extend through the piston assembly body 1010 from the outside surface 1013 to the inside surface 1014. The first and second chamber pressure inlets 1070, 1066 are aligned with pressure port 419 (FIG. 9) when module 330 is assembled on the rotor assembly 310. The first and second pressure outlets 1068 and 1064 are aligned with exhaust ports 418 when module 330 is assembled on the rotor assembly 310.

Figure 15:
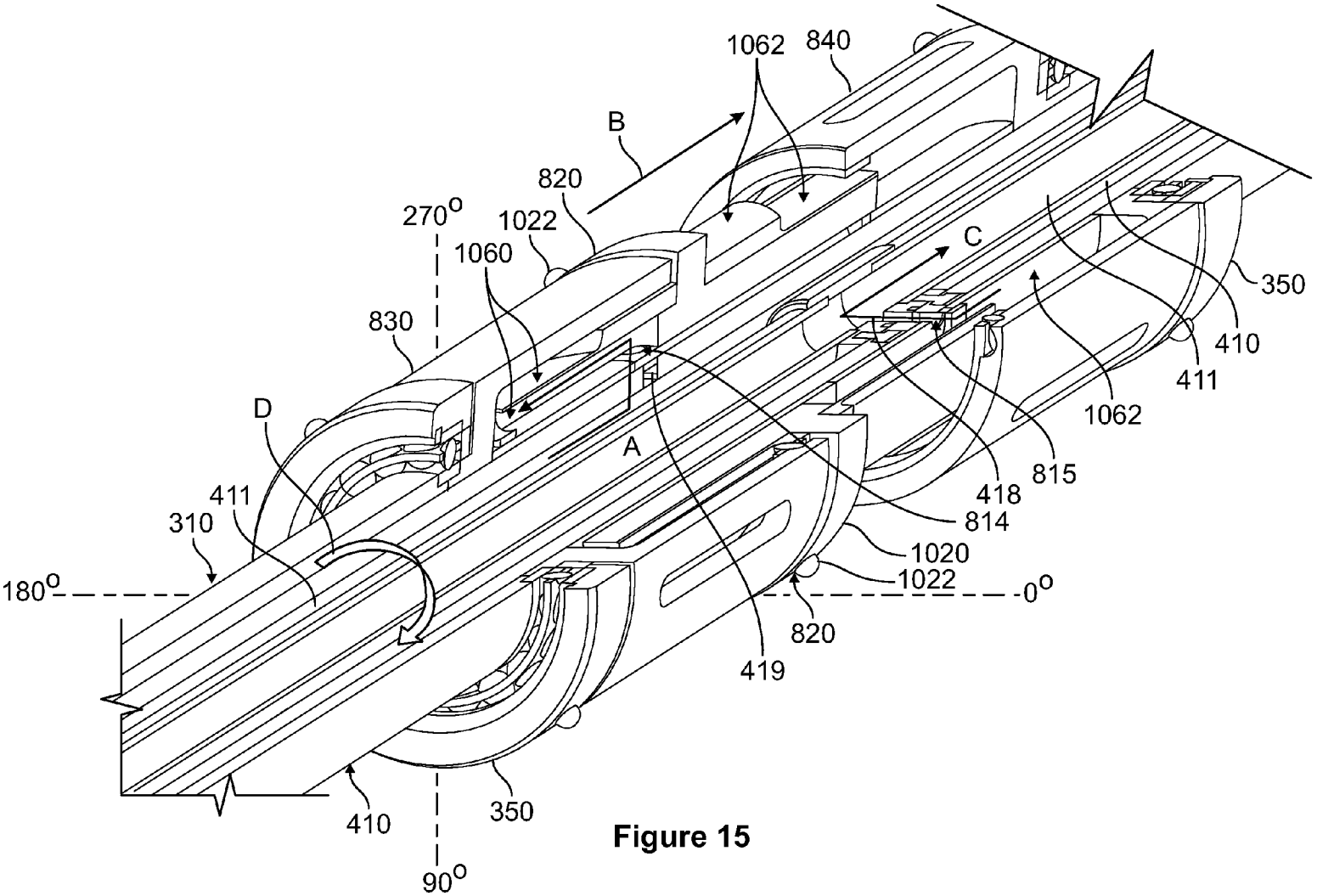
FIG. 15 shows a second module in position on a rotor assembly in an initial position of a cycle according to an embodiment of the disclosure.
Figure 16:
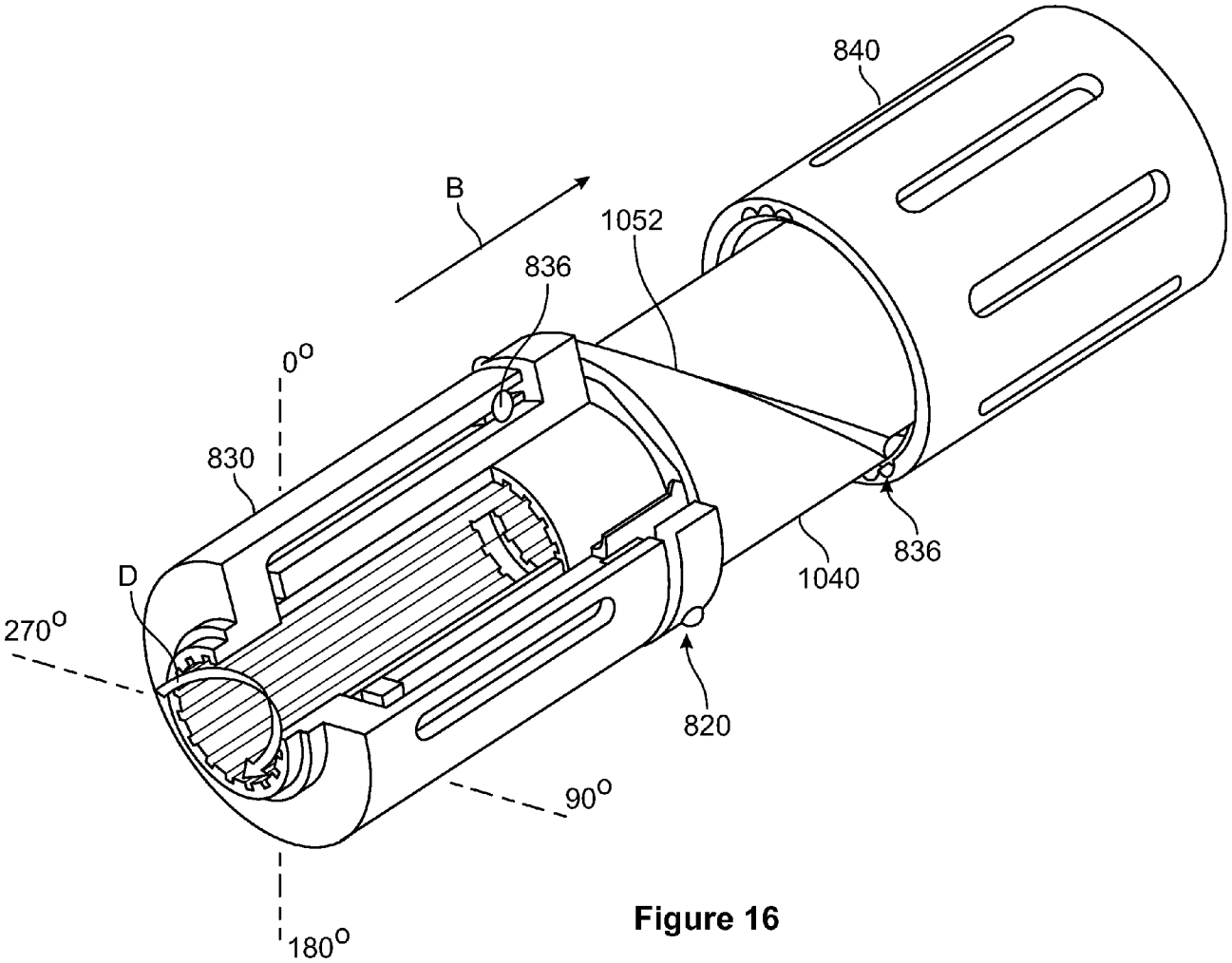
FIG. 16 shows a partial cut away view of a module assembly according to an embodiment of the disclosure.
Figure 17:
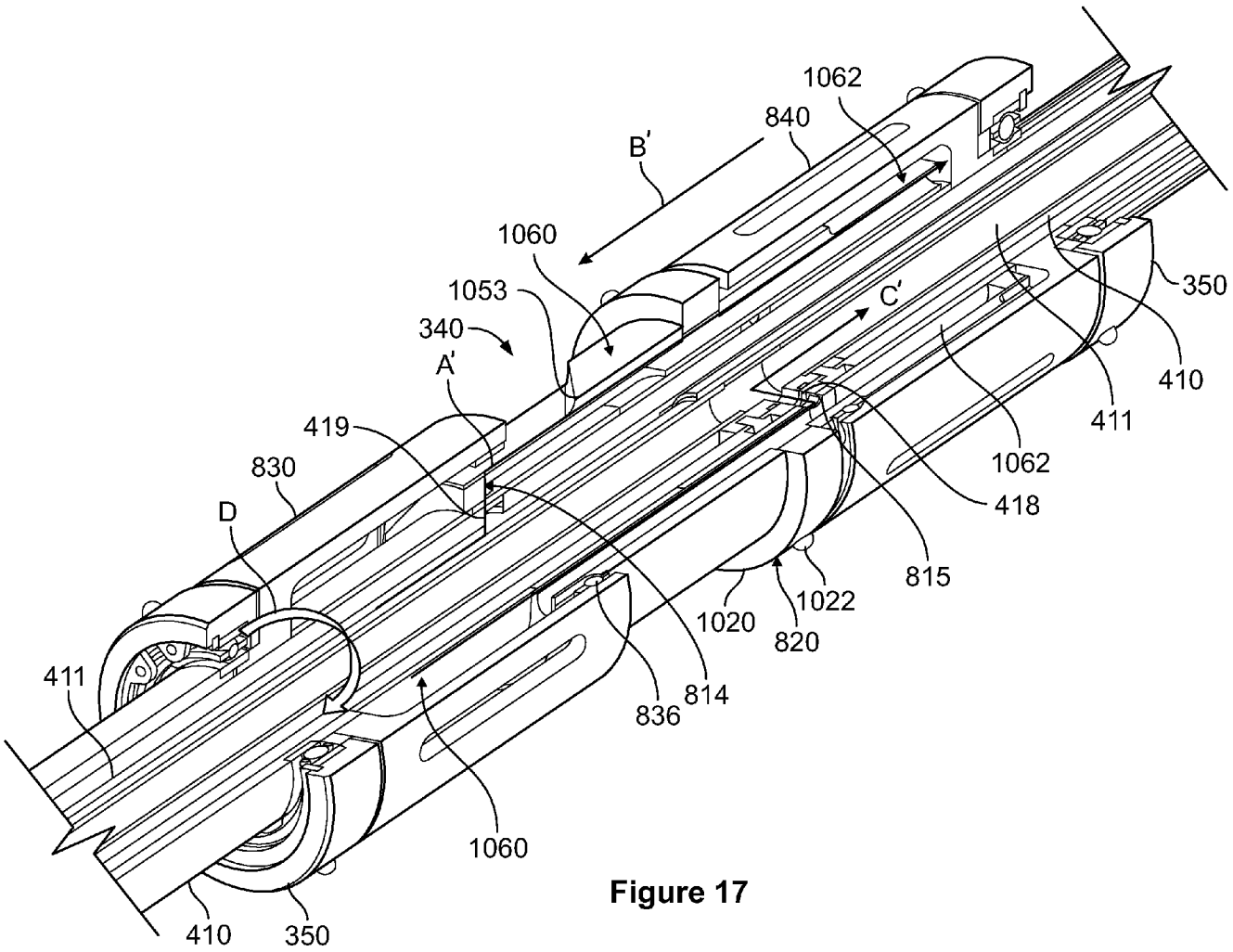
FIG. 17 shows a second module in position on a rotor assembly in a return position of a cycle according to an embodiment of the disclosure.

Referencing FIGS. 1, 15 and 17, it can be seen that the first and second chambers 1060, 1062 are the empty volume between the collar 1020 and the opposing bearings 350, respectively. The bearings 350 create a seal between the module assembly 330 and the housing 45. As the collar 1020 moves away from each chamber, the volume increases as fluid expands into the volume. As the collar 1020 move towards each volume, the volume decreases as the fluid is exhausted from the volume.

The fluid flow paths during a cycle of the piston assembly 820 will now be described referencing FIGS. 2, 11-14 and 15-18. FIG. 15 illustrates the second module 340 in position on the rotor assembly 310 in an initial position of a cycle. Note that the view of FIG. 15 has been rotated 90° from the view shown in FIG. 10. As can be seen in FIG. 15, the collar 1020 is nearly contacting the first torque coupler 830. Protrusions 1022 on the piston assembly collar 1020 are received in grooves (not shown) in the housing 45 (FIG. 1) that allow the piston assembly 820 to axially or linearly move in the housing 45, but not allowing the piston assembly 820 to rotate in the housing 45.

At this initial point of the cycle as shown in FIG. 15, the pressurized fluid is following the path indicated by arrow A. As can be seen in FIG. 15, the pressurized fluid is flowing towards the piston assembly 820 via through passage 411 of the rotor housing 410, exits pressure port 419, passes through the pressure inlet slot 814 of the valve sleeve 810, and enters first pressure inlet 1070 (see also FIG. 14) into the first chamber 1060. Pressure in the first chamber 1060 forces the piston assembly 820 in the direction indicated by arrow B. Simultaneously, fluid from the second chamber 1062 is exhausted as shown by arrow C via second pressure outlet 1064 to the exhaust outlet slot 815 and exhaust port 418 and into the through passage 411 of the rotor housing 410. The exhausted fluid is then received by the outlet section 40.

As the piston assembly 820 travels in the direction of arrow B, the ball 836 travels along the curved ridge 1052 (shown in FIG. 16, note that FIG. 16 has 0° TDC) of the second harmonic cam. As the ball 836 follows the curved ridge 1052 and the piston assembly 820 continues to travel, the second torque coupler 840 rotates in the direction shown by arrow D. The rotation of the second torque coupler 840 rotates the rotor assembly 310 in same direction D. The rotation of the rotor assembly 310 rotates the first torque coupler 830 in the same direction D.

FIG. 17 shows a point in time when the piston assembly 820 has traveled for the complete stroke length, and the collar 1020 is nearly contacting the second torque coupler 840. The stroke of the piston has produced one-half of a rotation in the rotor 310. Note that FIG. 17 shows 90° TDC (referencing FIG. 10). At this point, the pressurized fluid is flowing towards the piston assembly 820 via through passage 411 of the rotor housing 410, exits pressure port 419, passes through the pressure inlet slot 814 of the valve sleeve 810, and enters second pressure inlet 1066 (see also FIG. 12) into the second chamber 1062. Pressure in the second chamber 1062 forces the piston assembly 820 in the direction indicated by arrow B'. Simultaneously, fluid from the first chamber 1060 is exhausted as shown by arrow C' via first pressure outlet 1068 to the exhaust outlet slot 815 (shown on FIG. 17) and exhaust port 418 and into the through passage 411 of the rotor housing 410. The exhausted fluid is then received by the outlet section 40

As the piston assembly 820 travels in the direction of arrow B', the ball 836 travels along the curved ridge 1052 of the first harmonic cam 1030 (shown on FIG. 17). As the ball 836 follows the curved ridge 1052 and the piston assembly 820 continues to travel, the first torque coupler 830 rotates in the direction shown by arrow D. The rotation of the first torque coupler 830 rotates the rotor assembly 310 in same direction D. The rotation of the rotor assembly 310 rotates the second torque coupler 830 in the same direction D.

The cycle is repeated to continuously rotate the rotor assembly 310. It should be noted that the positioning of the pressure inlet slot 814 and the exhaust outlet slot 815 on the valve sleeve 810 (see FIG. 9) may be extended or retracted to time the input and exhaust of fluid to dynamically tune the cycling of the rotor assembly 310. Multiple modules (330, 340) are clocked or timed circumferentially by receiving and discharging fluid to provide continuous power distribution to the rotor assembly.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A motor, comprising:
a housing; and
a piston drive section disposed within the housing;
wherein the piston drive section comprises:
a rotor; and
a module assembly disposed around the rotor, the module assembly comprising:
a piston assembly having a first end and a second end;
and a first and second torque couplers coupled to the first and second ends of the piston assembly, respectively,
and further coupled to the rotor;
wherein axial motion of the piston assembly within the housing causes the first and second torque couplers to rotate the rotor.

2. The motor of claim 1, wherein
the first and second torque couplers comprise a protrusion that follows a ridge disposed on a top surface of the piston assembly as the piston assembly moves axially so that the first and second torque couplers are rotated.

3. The motor assembly of claim 1, wherein the rotor is an annular tube comprising:
a rotor housing comprising a first end and a second end, an exterior surface and an interior surface; and
an exhaust manifold disposed within the rotor housing;
wherein the exhaust manifold comprises an interior surface and an exterior surface and a manifold exhaust port connecting the interior surface to the exterior surface.

4. The motor assembly of claim 3, wherein the rotor housing further comprises:
a fluid pressure port between the interior and exterior surfaces; and
a fluid exhaust port between the interior and exterior surfaces.

5. The motor assembly of claim 4, wherein the manifold exhaust port is fluidly connected to the fluid exhaust port of the rotor housing.

6. The motor assembly of claim 1, wherein the piston assembly further comprises:
a first fluid chamber and a second fluid chamber and a valve sleeve comprising a pressure inlet slot and an exhaust outlet slot.

7. The motor assembly of claim 6, wherein the first and second fluid chambers are configured to receive and exhaust a fluid as the first and second fluid chambers come into fluid connectivity with the pressure inlet slot and the exhaust outlet slot as the piston assembly axially cycles in the housing.

8. A drilling assembly, comprising:
a housing;
a piston drive section disposed within the housing;
an output section coupled to the piston drive section; and
a drill bit coupled to the output section;
wherein the piston drive section comprises:
a rotor; and
a module assembly disposed around the rotor, the module assembly comprising:
a piston assembly having a first end and a second end;
and a first and second torque couplers coupled to the first and second ends of the piston assembly, respectively, and further coupled to the rotor;
wherein axial motion of the piston assembly within the housing causes the first and second torque couplers to rotate the rotor.

9. The drilling assembly of claim 8, wherein
the first and second torque converters comprise a protrusion that follows a ridge disposed on a top surface of the piston assembly as the piston assembly moves axial so that the first and second torque couplers are rotated.

10. The drilling assembly of claim 8, wherein the rotor is an annular tube comprising:

a rotor housing comprising a first end and a second end, an exterior surface and an interior surface; and an exhaust manifold disposed within the rotor housing; wherein the exhaust manifold comprises an interior surface and an exterior surface and a manifold exhaust port connecting the interior surface to the exterior surface.

11. The drilling assembly of claim 10, wherein the rotor housing further comprises:

a fluid pressure port between the interior and exterior surfaces; and a fluid exhaust port between the interior and exterior surfaces.

12. The drilling assembly of claim 11, wherein the manifold exhaust port is fluidly connected to the fluid exhaust port of the rotor housing.

13. The drilling assembly of claim 8, wherein the piston assembly further comprises:

a first fluid chamber and a second fluid chamber and a valve sleeve comprising a pressure inlet slot and an exhaust outlet slot.

14. The drilling assembly of claim 13, wherein the first and second fluid chambers are configured to receive and exhaust a fluid as the first and second fluid chambers come into fluid connectivity with the pressure inlet slot and the exhaust outlet slot as the piston assembly axially cycles in the housing.

15. A method of powering a motor, comprising:

providing a pressured fluid to an inlet of a rotor housing of a rotor of the motor;

porting the pressured fluid to a first chamber of a piston assembly disposed around the rotor at an initial position to drive a piston of the piston assembly in a first axial direction in the housing by the pressurized fluid;

porting the pressurized fluid from the first chamber to an exhaust manifold disposed within the rotor housing; and porting additional pressurized fluid to a second chamber of the piston assembly disposed around the rotor to drive the piston in a second axial direction opposite the first axial direction to return the piston to the initial position;

wherein driving the piston in the first axial direction rotates a first torque coupler that rotates a rotor.

16. The method of claim 15, further comprising:

porting the pressurized fluid from the second chamber to the exhaust manifold disposed within the rotor housing.

17. The method of claim 15, wherein driving the piston in the second axial direction rotates a second torque coupler that rotates the rotor.

18. The method of claim 15, wherein the piston assembly is coupled to the housing by engaging splines.

19. The method of claim 15, wherein rotating the rotor rotates a drill shaft coupled thereto.

* * * * *